US005875721A

United States Patent [19]

Wright et al.

[11] Patent Number: 5,875,721

[45] Date of Patent: Mar. 2, 1999

[54] RAILWAY CAR TRUCK AND METHOD AND APPARATUS FOR VELOCITY-DEPENDENT FRICTION DAMPING

[75] Inventors: James F. Wright, Washington; Aubra D. McKisic, Coraopolis, both of Pa.

[73] Assignee: Hansen Inc., Pittsburgh, Pa.

[21] Appl. No.: 654,187

[22] Filed: May 28, 1996

[51] Int. Cl.[6] ..... B61F 5/00

[52] U.S. Cl. ..... 105/198.2; 105/198.3; 105/198.5

[58] Field of Search ..... 105/190.2, 193, 105/197.05, 198.1, 198.2, 198.3, 198.4, 198.5

[56] References Cited

U.S. PATENT DOCUMENTS

| | | | |
|---|---|---|---|
| 1,983,088 | 12/1934 | Kiesel, Jr. | 105/197 |
| 2,284,696 | 6/1942 | Travilla et al. | 105/197 |
| 2,352,693 | 7/1944 | Davidson | 105/197 |
| 2,573,165 | 10/1951 | Settles | 105/197 |
| 2,624,291 | 1/1953 | Settles | 105/198.5 |
| 2,642,008 | 6/1953 | Settles et al. | 105/198.3 |
| 2,737,905 | 3/1956 | Holland et al. | 105/197 |
| 3,773,147 | 11/1973 | Wiebe | 188/33 |
| 4,109,586 | 8/1978 | Briggs et al. | 105/224 |
| 4,132,176 | 1/1979 | Wiebe | 105/197 |
| 4,167,907 | 9/1979 | Mulcahy et al. | 105/193 |
| 4,198,911 | 4/1980 | Wiebe | 105/197 |
| 4,245,563 | 1/1981 | Empson | 105/198.3 |
| 4,295,429 | 10/1981 | Wiebe | 105/198.4 |
| 4,936,226 | 6/1990 | Wiebe | 105/198.3 |
| 5,511,489 | 4/1996 | Bullock | 105/198.2 |

*Primary Examiner*—Mark T. Le
*Attorney, Agent, or Firm*—J. Stewart Brams

[57] ABSTRACT

Viscous damping such as provided by hydraulic dampers is employed to load frictional energy dissipating elements, such as friction wedges used to damp relative movements between the bolster and the side frames in a conventional railway car truck, such that the magnitude of frictional damping provided is dependent upon the velocity of relative movement between the truck bolster and side frames.

21 Claims, 7 Drawing Sheets

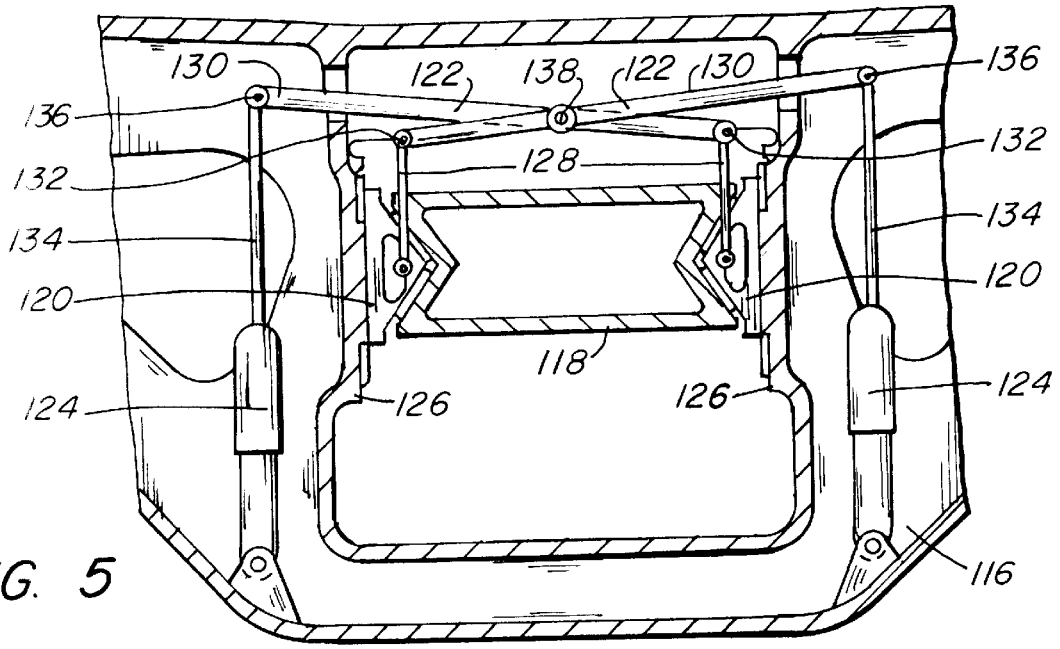
FIG. 5
FIG. 6
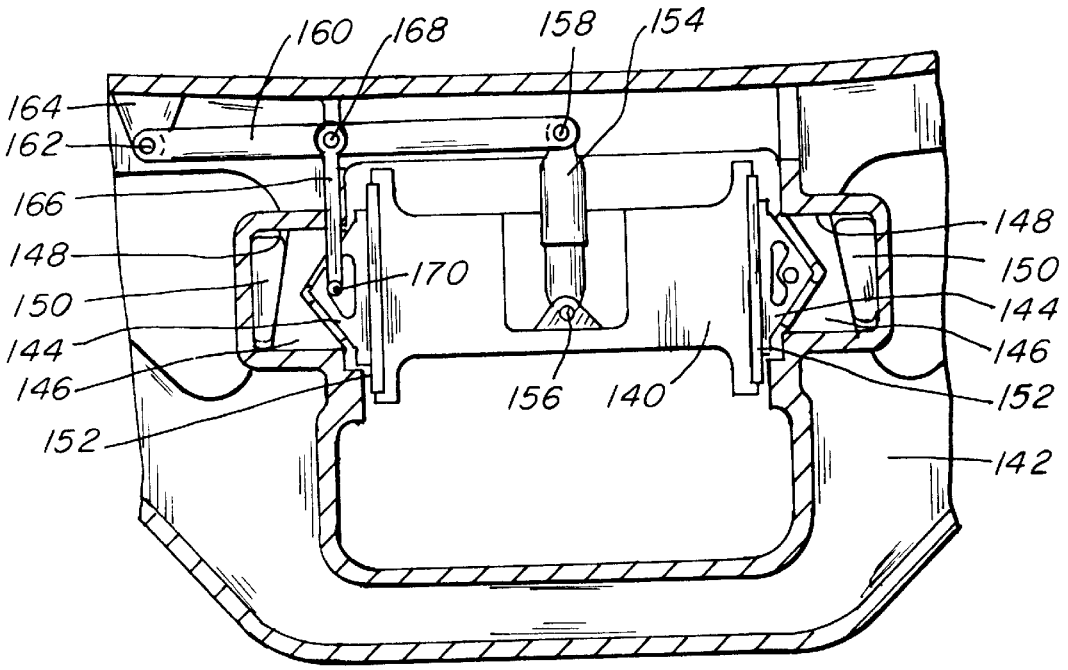

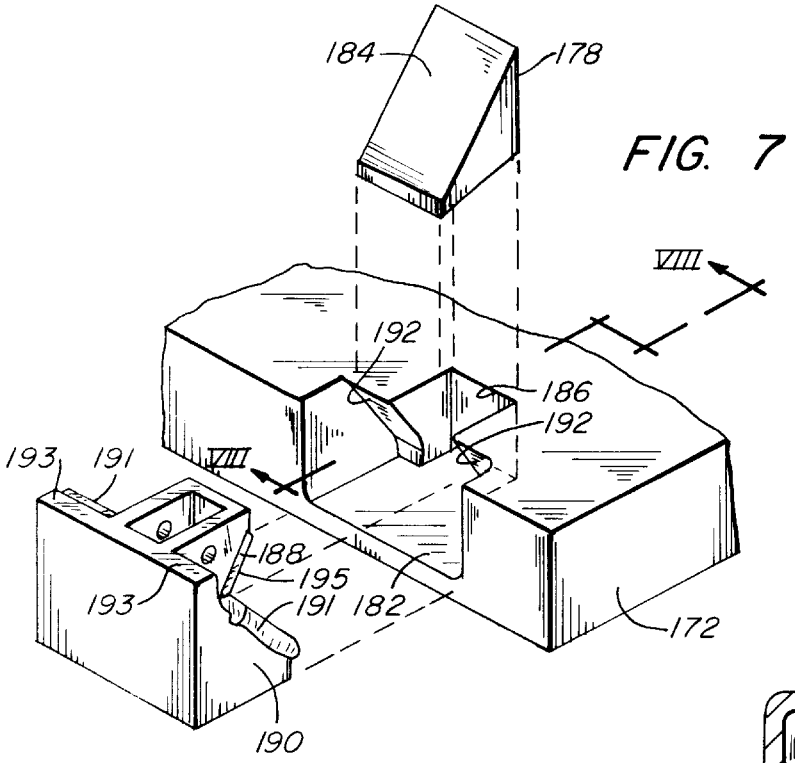
FIG. 7
FIG. 13
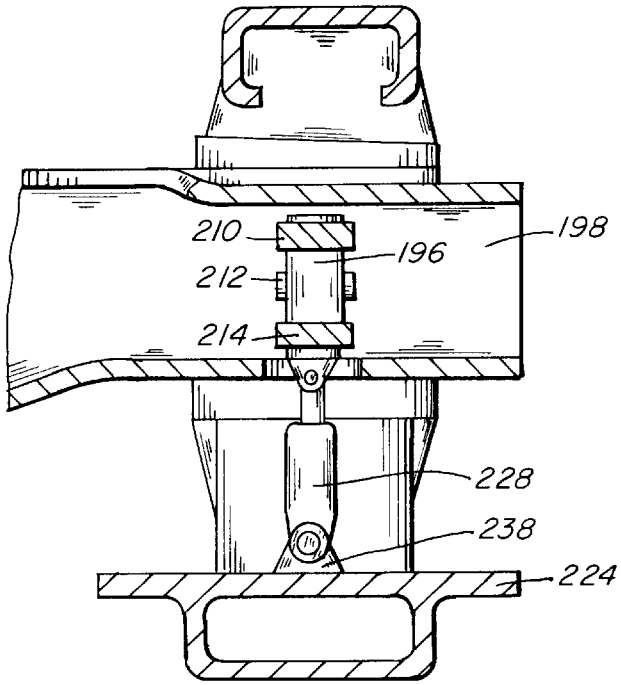

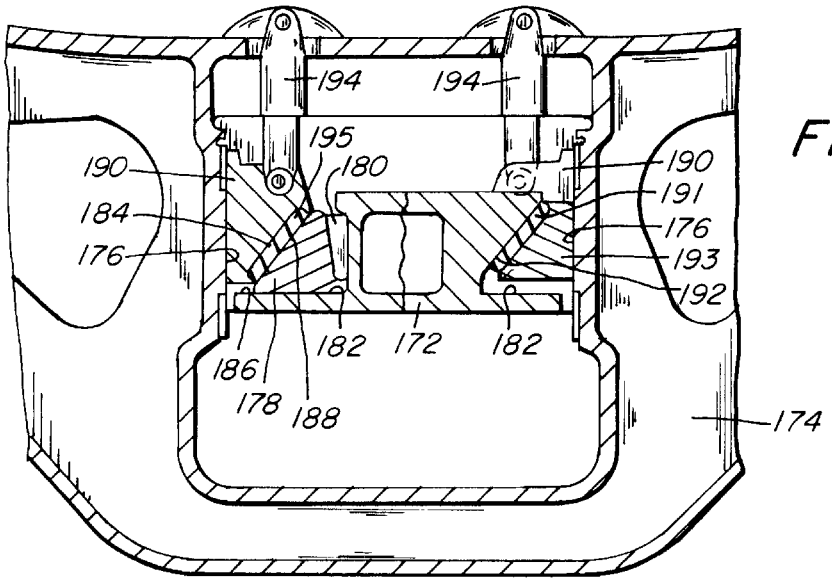
FIG. 8
FIG. 9
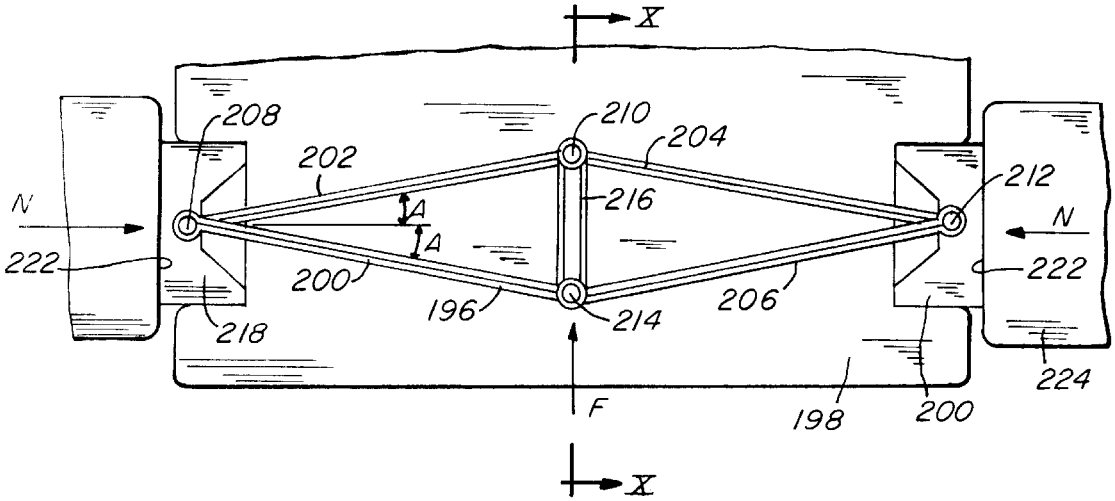

RAILWAY CAR TRUCK AND METHOD AND APPARATUS FOR VELOCITY-DEPENDENT FRICTION DAMPING

BACKGROUND OF THE INVENTION

Railway car trucks such as conventional three-piece freight car trucks have conventionally used sliding friction to dissipate energy during relative movement between the truck bolster and the side frame. Specifically, spring loaded friction shoes or wedges have been disposed between the bolster and the side frame so as to bear on generally vertical side frame column surfaces, and to slide on the column surfaces in response to relative movement of the bolster, both vertical and horizontal, with respect to the side frames. The resultant sliding friction between the friction shoes and the side frame column surfaces dissipates some of the energy associated with the movements of the bolster and side frames, and the car body. Such energy dissipation can improve ride quality and control truck hunting and truck warping.

A friction shoe typically is formed as a wedge which is biased into a bolster pocket against upwardly converging bolster pocket and side frame column surfaces, as is well known. To maintain such friction wedges in engagement with the bolster pocket and side frame column surfaces, mechanical spring force of either constant or varying magnitude has been used. One common means of friction wedge restraint has been an elongated compression spring extending between the side frame window floor and an undersurface of the friction wedge such that the biasing force which retains the friction wedge varies with the relative vertical position of the bolster with respect to the side frame.

The art is replete with examples of railway truck friction wedge arrangements, and although conventional friction wedges have generally been suitable for their intended purpose, practitioners in the art have continually sought improvements in friction wedge performance. For example, friction wedges can degrade vertical ride quality because they respond to any relative movement of the bolster with respect to the side frame with the same frictional restraint. That is, all relative bolster to side frame displacements of any velocity, and whether large in magnitude or small, result in full frictional damping force per unit of frictional sliding movement by the friction wedges on the column surfaces. This can degrade ride quality; however, if the friction forces evolved by conventional friction wedges are kept small out of concern for ride quality, the result may be insufficient damping for the more violent bolster movements with respect to the side frame. Such movements may require greater energy dissipation in order to prevent such undesirable results as spring bottoming or evolution of harmonic responses resulting from periodic force inputs.

A great many friction shoe structures and railway trucks adapted to use them are known from the prior art, including U.S. Pat. Nos. 4,109,586, 2,352,693 and 2,737,905.

To deal with the described limitations of frictional damping, one approach has been to add supplemental damping, for example viscous damping such as provided by hydraulic dampers, to further restrain relative bolster to side frame movement in railway trucks. The damping response of a hydraulic damper generally is velocity dependent so that for small and/or slow relative movements, the hydraulic damper develops limited restraint whereas, in response to larger velocity, amplitude or frequency of relative movement, the hydraulic damper evolves greater restraining force. The prior art contains numerous examples of hydraulic dampers applied in railway trucks including U.S. Pat. Nos. 4,936,226, 4,198,911, 3,773,147, 4,132,176, 2,573,165, 2,284,696, 1,983,088, and the above-referenced U.S. Pat. No. 4,109,586.

Like conventional friction wedges, conventional hydraulic railway truck dampers also have been generally suitable for their intended purposes although improvements have nonetheless been continually sought. For example, the velocity dependent damping of conventional hydraulic dampers typically has been single-acting, which means that for a given level of energy removal twice the force is necessary as that which would be necessary if the hydraulic damper were double-acting. In addition, prior hydraulic dampers have acted directly between a railway truck bolster and side frame, thus being completely independent of friction wedge operation. Although often helpful in controlling evolution of harmonic responses, some known railway truck hydraulic dampers are less effective in improving vertical ride quality. Furthermore, frequent hydraulic damper operation in response to rapid, but small amplitude relative bolster to side frame movements during normal running may result in considerable heat build up in the damper with consequent reduction in damper service life.

BRIEF SUMMARY OF THE INVENTION

The invention contemplates an improved structure and method for damping relative movement between a railway truck bolster and side frames (or similar truck components) by means of a velocity dependent damper, such as a hydraulic damper, which loads a friction member, either alone or in combination with the loading provided by a conventional compression spring. The magnitude of friction evolved by the friction member thus is influenced by the component of total loading supplied by the velocity dependent damper, which in turn depends upon multiple factors including the magnitude and velocity of the relative movement between the bolster and the side frame.

One benefit of the invention is that the effect of a velocity dependent damper is greatly magnified by using it to load the friction member. The relative movement between a bolster and side frame is resisted by both the damper force and the friction member friction force induced by the damper. Accordingly, proportionally more of the damping occurs at the friction interface rather than in the velocity dependent damper, and this in turn prevents undue heating and wear in the velocity dependent damper.

Another benefit of the invention is that both frictional and viscous damping forces are reduced when relative bolster to side frame movement is of minimal magnitude and/or velocity, with larger magnitude damping or restraint forces being evolved for larger magnitude and/or velocity relative bolster to side frame movement. This has the potential to significantly improve railway car ride quality. For improved wear characteristics, the hydraulic damper, or the mechanism which connects it to the friction member, may be provided with a dead-band zone, that is, a small range of movement from a stationary position in which it provides effectively no response to relative movement between the bolster and side frame.

According to the invention, a velocity dependent damper and respective friction member or members can be double-acting so that, for a given quantity of energy dissipation per movement cycle, half the restraining force of a single-acting energy dissipation device or combination will suffice.

It is therefore one object of the invention to provide a novel and improved method and apparatus for providing restraint to dissipate the energy of relative movement between a railway car truck bolster and side frames.

A further object of the invention is to provide such improved energy dissipation with a damping apparatus for damping relative bolster to side frame movement in a railway truck wherein frictional damping is evolved at a magnitude which is dependent upon the velocity of the relative movement between the truck bolster and the side frames.

A more specific object of the invention is to provide improved energy dissipation in a railway truck through the use of a friction member and velocity dependent damper combination wherein the velocity dependent damper directly loads the friction member to thereby favorably influence the magnitude of frictional damping evolved.

A still further object of the invention is to provide a combined dry friction and viscous damping combination in a railway truck wherein the combination is double-acting to restrain relative bolster movements in both vertical directions.

Yet another object of the invention is to provide a dry friction and viscous damping combination for damping relative movement between a bolster and the side frames in a railway truck wherein viscous damping occurs essentially only for relative bolster to side frame movements larger than a predetermined magnitude, by virtue of a dead-band operating zone provided for the viscous damper.

These and other objects and further advantages of the invention will be more fully appreciated upon consideration of the following detailed description, and the accompanying drawings, in which:

FIG. 5 is a view similar to FIG. 1 showing still another presently preferred embodiment of the invention;

FIG. 6 is a view similar to FIG. 1 showing still another presently preferred embodiment of the invention;

FIG. 7 is an exploded, perspective view of another embodiment of the invention;

FIG. 8 is a sectioned side elevation taken on lines VIII—VIII of FIG. 7;

FIG. 9 is a fragmentary, generally schematic top plan view of a part of a railway truck showing a further embodiment of the invention;

FIG. 13 is a view similar to FIG. 10. showing yet another alternative to the embodiment of FIG. 10

All disclosure herein which is pertinent to any claimed method, including but not limited to disclosure of how any described embodiment operates, is intended to be understood as part of the method disclosure irrespective of whether such disclosure is specifically identified as method disclosure.

Figure 1:
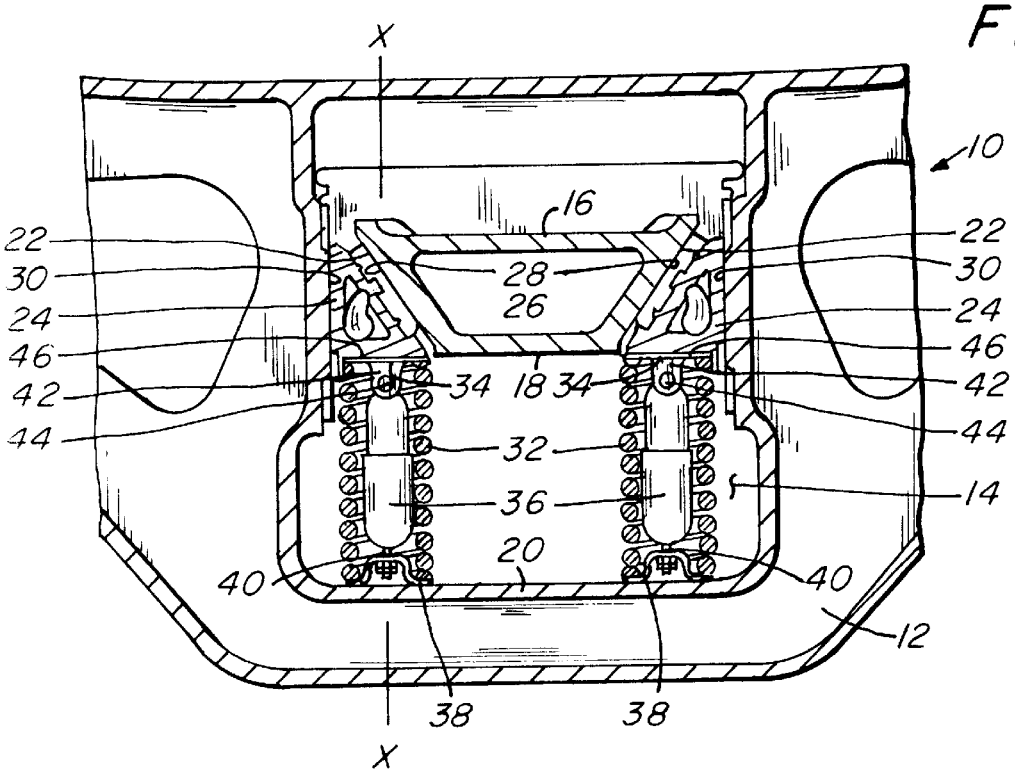
FIG. 1 is a fragmentary, sectioned side elevation of a railway truck illustrating the invention according to one presently preferred embodiment thereof.

There is generally indicated at 10 in FIG. 1 a fragmentary part of a railway truck including a side frame 12 having a central window or opening 14 into which projects one end of a railway truck bolster 16 which is supported therein by conventional load springs (not shown) extending between an under side 18 of bolster 16 and a floor 20 of window 14.

Bolster 16 includes longitudinally opposed pockets 22 which receive friction shoes 24 or friction shoe combinations, preferably but not necessarily including elastomeric pads 26 as shown. Friction shoes 24 are wedged-shaped for fit-up with a pair of upwardly converging surfaces including a bolster pocket surface 28 and a generally vertical column wear surface 30. Friction shoes 24 may be biased into engagement with surfaces 28 and 30 by conventional retention springs 32 extending between an undersurface 34 of each friction shoe 24, respectively, and floor 20 of window 14.

All of the above described elements are well known in the art and form no part of the instant invention, excepting only insofar as they may form portions of novel combinations for operation of novel methods as described hereinbelow; however, as the above described elements per se are well known, further detailed description thereof is believed to be unnecessary for an understanding of the present invention. Further detailed description of such known elements is found in abundance in the prior art.

The truck assembly of FIG. 1 further includes a pair of velocity dependent dampers, preferably hydraulic dampers 36, extending vertically between floor 20 of window 14 and the respective undersurfaces 34 of friction shoes 24. Dampers 36 may extend axially within the confines of coil springs 32, for example.

The dampers 36 are flexibly mounted with respect to side frame 12 and friction shoes 24. For example, brackets 38 may be carried by floor 20 to retain a lower end retention portion 40 of the respective hydraulic dampers 36. The assembly of brackets 38 to retention portions 40 may include any suitable means for providing a range of angular flexibility, elastomeric bushing means for example, to permit angular movement of the dampers 36, within limits, with respect to a vertical axis X—X. Similar flexibility is desirable in the upper end mounting of the hydraulic dampers 36, for example any suitable eye and clevis arrangement 42 with a pivot pin 44 for securing a spring retention plate 46 to the upper end of each hydraulic damper 36.

Each assembly of a hydraulic damper 36 with a bracket 38 and a retention plate 46 serves to retain one of springs 32 in assembly therewith, preferably in a partially compressed state. These assemblies are disposed as above described to extend between floor 20 of window 14 and the undersides of the respective friction shoes 24. In order to fit the space between floor 20 and friction shoes 24 with bolster 16 in any operating position, the described spring and damper assemblies are compressed further so that for all vertical operating positions of bolster 16 with respect to side frame 12 the compression loading of springs 32 loads respective friction shoes 24 thereby maintaining engagement of the shoes 24 on pocket surfaces 28, and frictional engagement thereof with column surfaces 30.

In the FIG. 1 embodiment, hydraulic dampers 36 may be single-acting dampers which provide an increment of friction shoe loading in addition to that provided by springs 32 only upon relative downward movement of bolster 16 that is of sufficient magnitude and/or velocity to develop a restraining force response by hydraulic dampers 36. Of course, as noted above if dampers 36 include a dead-band zone, this will further limit and control the velocity and magnitude of downward bolster movement which will actuate hydraulic dampers 36 to provide a corresponding increment of friction shoe loading. The dampers 36 may alternatively be double-acting devices as described further hereinbelow, to provide a restraining force for both upward and downward bolster movement.

For single-acting hydraulic dampers 36, upward movement of bolster 16 in FIG. 1 will not evolve any significant hydraulic damper loading of friction shoes 24. Furthermore, the hydraulic dampers 36 may operate such that, for downward bolster movement less than a given minimum velocity and/or magnitude, as determined by the designer, the hydraulic dampers produce essentially no friction shoe loading. Hence, for such movements essentially all damping of the relative movement between the bolster and side frame will be provided by dissipation of energy through frictional sliding of shoes 24 on column surface 30. This, in turn, is governed by the force of springs 32 acting on respective shoes 24, and hence on the degree of compression of springs 32.

For vertically downward bolster movements with respect to side frame 12 of a magnitude and/or velocity greater than the given minimum, the friction shoes 24 are loaded not only by springs 32, but in addition by the restraint of hydraulic dampers 36. The additional loading provided by dampers 36 increases the normal force with which shoes 24 engage surfaces 30, thereby increasing the magnitude of frictional energy dissipation for higher magnitude and/or velocity relative bolster movements. In addition, the hydraulic dampers themselves will provide viscous damping for further dissipation of energy. Energy dissipation thus is achieved essentially exclusively with frictional damping for relative bolster movements of smaller magnitude and/or velocity, with minimal wear on the hydraulic dampers 36, and with a combination of increased frictional damping and viscous damping for relative bolster movements of larger magnitude and/or velocity. The preferred damper will provide a velocity dependent response, by such means as viscous fluid damping for example. This is the meaning to be understood from references herein to viscous dampers.

For this and all other described embodiments of the invention, the damper to be provided may be a rather generic device, not unlike an automotive hydraulic shock absorber in concept. The actual damper to be used may take any of several modified forms including rotary dampers and pneumatic-assist dampers, among others. The particular damper features and operating characteristics will depend upon the design characteristics and limitations which the designer intends to satisfy. Accordingly, identification of suitable damping characteristics, and a damper to provide them, for any given car will require analysis of the dynamic response of the car. Freight car dynamic response includes bounce, pitch and roll movements, among others. These modes of movement are greatly affected by the vertical damping in the secondary suspension, The appropriate magnitude of damping will be determined by the designer, taking account of such variables as car configuration, spring rate and travel, lading tolerance to vertical oscillation, and expected track conditions and operating speeds, among other factors. One resource for computer modeling of rail car dynamic behavior is the NUCARS program (New and Untried Car Analytic Regime Simulation), developed and administered by the Association of American Railroads.

Figure 2:
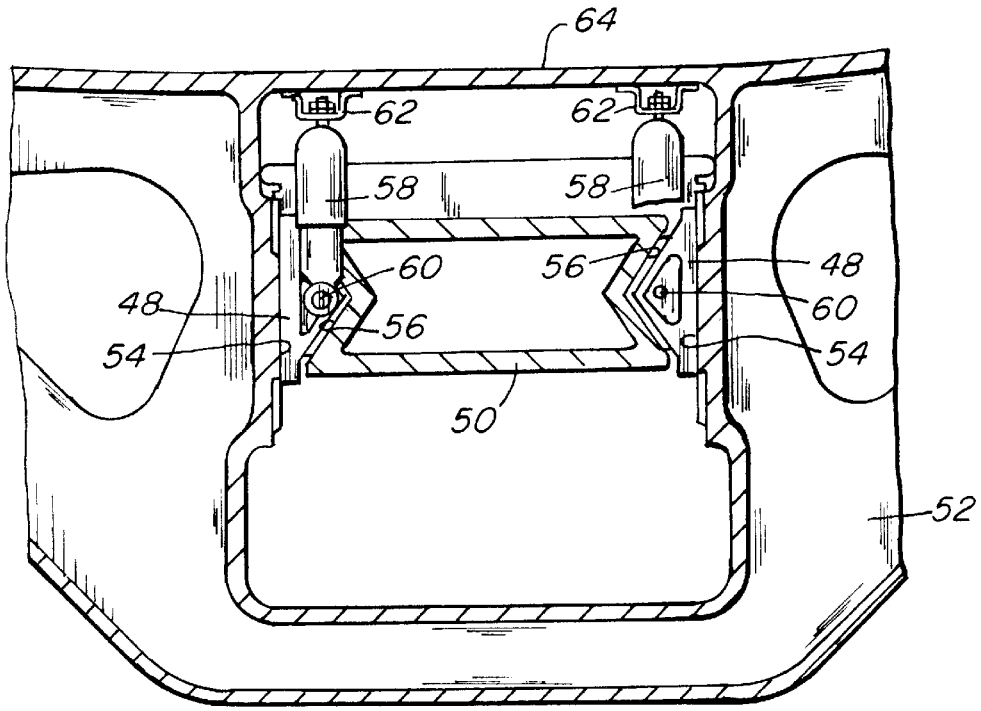
FIG. 2 is a view similar to FIG. 1 showing another presently preferred embodiment of the invention.

FIG. 2 illustrates an alternative embodiment of the invention wherein the friction shoes 48 are disposed in fit-up with a bolster 50 and a side frame 52, the shoes 48 being engaged for frictional sliding upon column wear surfaces 54 of side frame 52. The FIG. 2 embodiment is an example of a double-acting arrangement wherein, by virtue of the shoe configuration and corresponding v-shaped retention surfaces 56 of bolster 50, the frictional sliding of shoes 48 on surfaces 54 can provide uniform frictional energy dissipation for movements in both vertical directions and at any elevation of the bolster 50 with respect to side frame 52. The arrangement illustrated in FIG. 2 dispenses with retention springs such as the springs 32 of FIG. 1 so that the friction shoe retention force, and hence the normal force between friction shoes and the column wear surfaces, is not influenced by the magnitude of compression of a retention spring according to the relative vertical position of the bolster.

With such a double-acting arrangement, a suitable wear take-up means, for example gravity wedges as disclosed hereinbelow, may desirably be provided to maintain the proper fit-up of shoes 48 with respect to column surfaces 54 and bolster 50. In addition or alternatively, suitable biasing means (not shown) may be provided to maintain a biased engagement of shoes 48 on surfaces 54 to thereby maintain a uniform normal force of frictional engagement.

Also as shown in FIG. 2, dampers 58 extend between side frame 52 and friction shoes 48 to provide velocity dependent damping and friction shoe loading in a double-acting structure, that is, one which is operative in response to bolster movements in both vertical directions, much as described hereinabove with reference to FIG. 1. In FIG. 2, however, dampers 58 extend from suitable pivot connections 60 with friction shoes 48 to mountings 62 suitably affixed to side frame 52 adjacent an upper portion 64 thereof. Mountings 62 may be similar to brackets 38 of FIG. 1, for example.

Figure 3:
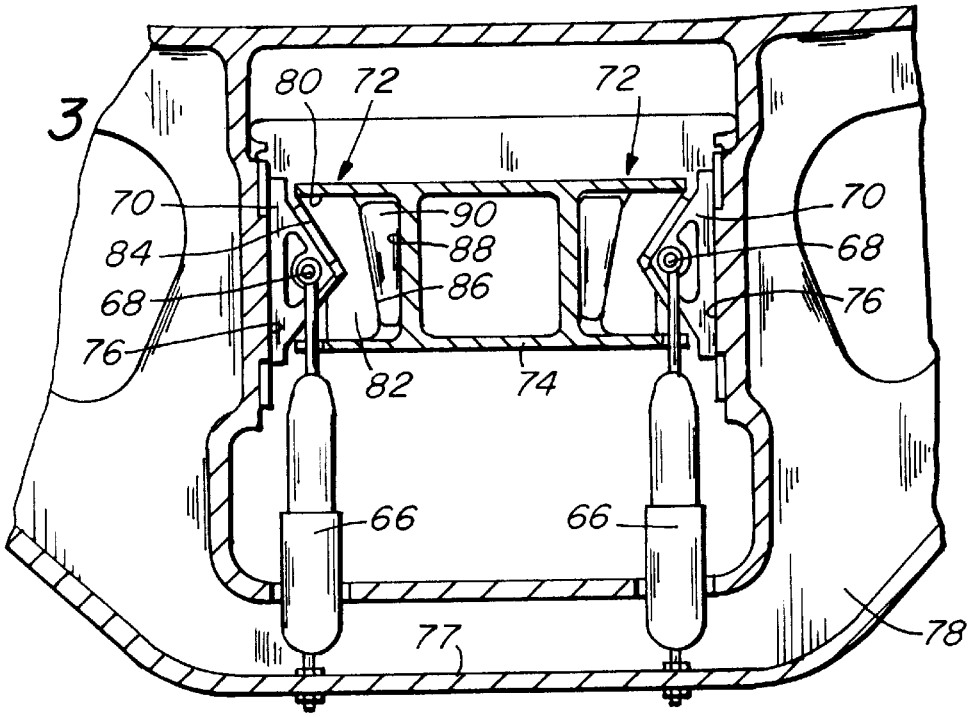
FIG. 3 is a view similar to FIG. 1 showing another presently preferred embodiment of the invention.

FIG. 3 illustrates an alternative embodiment similar to FIG. 2 but with velocity dependent dampers 66 extending between a floor or base portion 77 of side frame 78, and pivotal connections 68 on friction shoes 70. A gravity wedge arrangement generally indicated at 72 maintains the fit-up of friction shoes 70 with bolster 74 and column surfaces 76 of side frame 78.

Each gravity wedge arrangement 72 includes a pocket 80 formed in bolster 74 for confronting relationship with one of the column surfaces 76. A shoe retaining member 82 is disposed within pocket 80 and includes a v-shaped surface means 84 for engagement with shoe 70, and an opposed surface 86 which is inclined with respect to a confronting surface 88 of pocket 80 so that the surfaces 86 and 88 converge downwardly. A gravity wedge 90 is disposed between surfaces 86 and 88 and engages them whereby gravity acting on wedge 90 continuously urges member 82 outwardly of pocket 80 and toward surface 76. The shoe 70 is thereby maintained in uniformly tight fit-up with bolster 74 and side frame column surfaces 76.

The gravity wedge arrangement 72 thus provides for easy assembly and fit-up, automatic compensation for slack, and compensation for progressive wear in all elements affecting the fit-up and generation of friction between friction shoes 70 and column surfaces 76.

Figure 4:
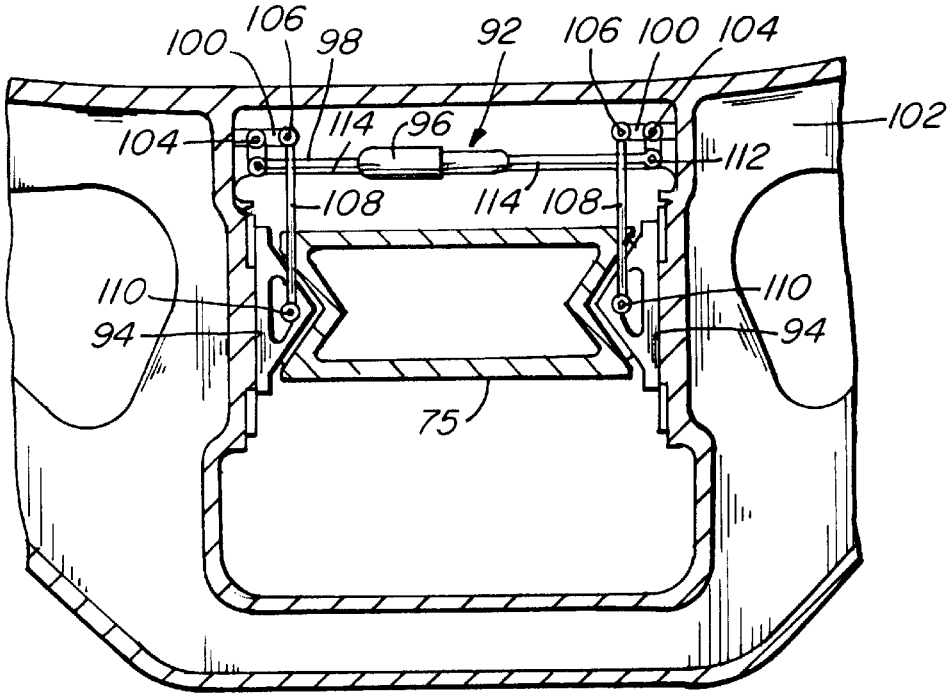
FIG. 4 is a view similar to FIG. 1 showing still another presently preferred embodiment of the invention.

FIG. 4 illustrates another alternative embodiment similar in many respects to that of FIGS. 2 and 3, but wherein the velocity dependent loading and restraint applied to the friction shoes is provided by a link-actuated viscous damper arrangement generally indicated at 92. More specifically, the bolster, side frame and friction shoe arrangement of FIG. 4 is similar in all salient respects to that illustrated in FIG. 2, as described hereinabove. Although not shown, the FIG. 4 embodiment also contemplates use of a slack take-up or wear compensation structure such as gravity wedge arrangement 72 of FIG. 3.

In addition, the embodiment of FIG. 4 contemplates loading of friction shoes 94 through a viscous damper 96, preferably a double-acting damper, through an arrangement of links 98 comprised of a pair of bellcranks 100 pivotally mounted with respect to side frame 102 as indicated at 104. One arm of each bellcrank 100 extends horizontally and is pivotally connected at 106 to an elongated link 108 which, in turn, is pivotally connected to one of shoes 94 as indicated at 110. The other arm of each bellcrank 100 extends vertically and is pivotally connected at 112 to an elongated link 114. The links 114 are affixed to the opposed ends of damper 96. Vertically upward or downward movement of bolster 75 urges shoes 94 upwardly or downwardly, thereby actuating damper 96 through the action of link arrangement 98. Damper 96 thereby loads shoes 94 through link arrangement 98 with a velocity dependent restraint to resist or restrain vertical movement of shoes 94 in essentially the same manner as above described with reference to other embodiments. The FIG. 4 embodiment permits a single damper to load two friction shoes in a manner allowing unimpeded motion for differential, but not additive, vertical motions of the two friction shoes 94.

FIG. 5 illustrates another alternative embodiment similar in many respects to the FIG. 4 embodiment in that double-acting friction shoes are connected by a linkage arrangement to viscous dampers. As with the FIG. 4 embodiment, suitable slack take-up and wear compensation such as described elsewhere herein is contemplated for the FIG. 5 embodiment, but is not shown. The FIG. 5 embodiment permits the dampers to be located in the space behind the side frame column guides. Specifically, a side frame 116 and bolster 118 are assembled in fit-up with friction shoes 120 much as described hereinabove with reference to FIGS. 3 and 4. Identical linkage assemblies 122 connect the respective shoes 120 to viscous dampers 124 located behind the column guide portions 126 of side frame 116.

Each linkage arrangement 122 includes an elongated link 128 extending vertically upward from and pivotally connected to a respective one of shoes 120. An elongated link 130 is pivotally connected to an upper end of each link 128 as at 132. The opposed end of each link 130 is pivotally connected to another vertically extending elongated link 134 as at 136. Intermediate pivots 132 and 136, links 130 are pivotally fixed with respect to side frame 116 as at 138. As shown, the pivot 138 may be a common pivot connection to side frame 116 for both of links 130.

With the link arrangement 122, vertical movement of the left hand shoe 120 actuates the right hand damper 124 whereas similar movement of the right hand shoe 120 actuates the left hand damper 124. Operation of the FIG. 5 embodiment corresponds essentially to the operation described hereinabove with reference to FIG. 4, except that separate dampers are used to load the respective friction shoes 120.

FIG. 6 illustrates yet another alternative embodiment of the invention which includes features from various above described embodiments. Specifically, a bolster 140 is assembled in fit-up with a side frame 142 with friction shoes 144 retained with respect to side frame 142 by respective retention members 146 similar to those described hereinabove with reference to FIG. 3. In this embodiment, however, retention members 146 are received within pockets 148 formed in side frame 142. A gravity wedge arrangement 150 that is similar in all salient respects to that described with reference to FIG. 3 operates to take up slack and compensate for wear thereby maintaining shoes 144 in frictional sliding engagement with surfaces 152 of bolster 140. Accordingly, as with all other embodiments described hereinabove, vertical movement of bolster 140 with respect to side frame 142 is restrained, and the energy of such relative vertical movement is dissipated by frictional sliding of shoes 144 on surfaces 152.

A viscous damper 154 is pivotally affixed to bolster 140 as at 156 and extends upwardly therefrom. The upper end of damper 154 is pivotally connected as at 158 to an elongated, generally horizontal link 160 having its opposed end pivotally affixed as at 162 with respect to a mounting portion 164 of side frame 142. Intermediate the pivots 158 and 162, a generally vertically extending elongated link 166 is pivotally connected to link 160 as at 168. The opposed end of link 166 is pivotally connected to shoe 144 as at 170.

In FIG. 6, only the linkage arrangement connecting the left hand shoe 144 to damper 154 is shown. An entirely similar linkage arrangement is employed to connect the right hand shoe 144 to damper 154.

Operation of the FIG. 6 embodiment will be seen to correspond essentially to that described above with reference to the double-acting shoe and viscous damper arrangements such as shown in FIGS. 2 through 5. More specifically, when bolster 140 moves vertically with respect to side frame 142, frictional sliding between bolster 140 and the friction shoes 144 occurs.

In addition, however, the loading provided by damper 154 through links 160 and 166 loads the shoes 144 thereby exerting a force in the vertical direction which opposes the direction of relative vertical movement of the shoes 144 with respect to bolster 140. The resulting operational characteristic for the FIG. 6 embodiment thus corresponds to that described with reference to other embodiments hereinabove. Of course, with the described or any other linkage arrangements connecting a friction shoe to a viscous damper, the operating characteristic of the arrangement can be varied within an available design latitude by changing the link dimensions and moving the pivot points. In addition, other linkage arrangements than those shown and described herein can be employed.

FIGS. 7 and 8 illustrate another alternative embodiment of the invention in which a double-acting arrangement is incorporated in an existing Ride Control (trademark of American Steel Foundries) type truck by placing a separate wedge element into a central portion of the bolster pocket to provide downwardly converging wedge and column surfaces to receive a friction shoe, as shown in FIG. 7. Also as shown, the friction shoe fits-up with upwardly converging bolster pocket and column surfaces disposed laterally outward of the central pocket portion.

More specifically, in FIGS. 7 and 8 a bolster 172 is assembled in fit-up with a side frame 174. Friction assemblies are carried by bolster 172 for frictional engagement with column guide surfaces 176 of side frame 174. As shown in FIG. 7 and the right hand portion of FIG. 8, each friction assembly includes a shoe 190 received within the bolster pocket 182, the pocket 182 being provided with a pair of spaced apart surface means 192 which converge upwardly with respect to a corresponding column guide surface 176. The pocket 182 thus receives shoe 190 in a manner that laterally projecting wing portions 193 of shoe 190 engage the surfaces 176 and 192. A double acting viscous damper 194 extends between and is pivotally connected to each shoe 190 and side frame 174 to load the shoes 190 in response to vertical movement of bolster 172. Accordingly, downward movement of bolster 172 causes shoe 190 to slide in frictional engagement upon surface 176, as shown in the right hand portion of FIG. 8.

As further shown in FIG. 7 and the left hand portion of FIG. 8, the friction assembly also includes a wedge insert 178 and gravity actuated slack take-up and wear compensation element 180 (not shown in FIG. 7) received within a central portion 186 of pocket 182 intermediate surfaces 192. A surface 184 of wedge insert 178 converges downwardly with respect to column guide surface 176 and engages a corresponding surface 188 of friction shoe 190. The viscous dampers 194, being double acting, also load shoes 190 in response to upward movement of bolster 172, and the wedging action of surfaces 176 and 184 thus causes shoes 190 to frictionally engage surfaces 176 during upward bolster movement.

From the above, it may be seen that for bolster movement in either vertical direction with respect to side frame 174, the friction shoes 190 will be loaded for frictional engagement with the corresponding column guide surfaces 176 to thereby provide frictional energy dissipation. As with other described embodiments, the FIGS. 7 and 8 embodiment may include elastomeric elements such as elements 191 and 195 intermediate shoes 190 and the respective bolster pocket and/or wedge insert surfaces.

FIGS. 9 to 12 illustrate further embodiments of the invention. In all embodiments described hereinabove the mechanical advantage developed between the viscous damper force and the normal force loading between the column and the friction member is obtained by virtue of a wedging action, for example as by the commonly used wedge-like friction shoe structure of FIG. 1. Where such wedging action is used, the maximum value of the ratio between total energy and the energy absorbed by the viscous damper is limited by the wedge angle. If the wedge angle is too small, however, the friction shoe can self-lock, thereby becoming inoperative as an energy dissipating device.

Figure 10:
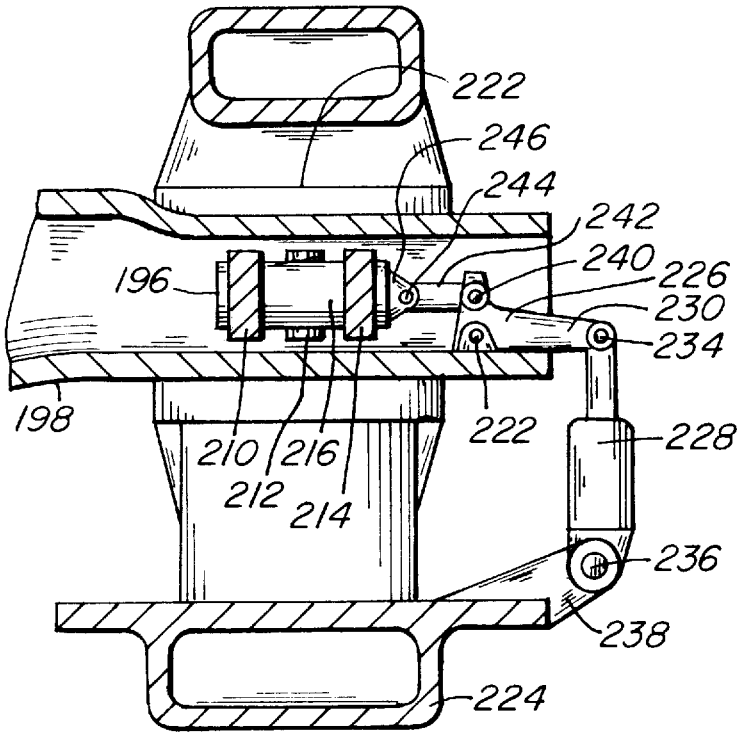
FIG. 10 is a sectional view taken on line X—X of FIG. 9.

The embodiments of FIGS. 9 to 12 eliminate any self-locking possibility by applying the mechanical advantage between damper force and column load through a pantograph assembly. Such a structure is shown in FIG. 9 as a pantograph assembly 196 arranged preferably within the vertical section of a bolster 198 (FIG. 10). Pantograph assembly 196 is comprised of a four-sided linkage arrangement including links 200, 202, 204 and 206, these links being connected end to end by respective pivots 208, 210, 212 and 214. An additional link 216 extends between and is pivotally affixed to pivots 210 and 214 in common with the respective links 200, 202 and 204, 206, as shown. The link 216 serves, among other purposes, to limit the maximum separation of pivots 210 and 214. At pivots pivots 208 and 212 the respective links are pivotally connected to friction blocks 218 and 220, and the friction blocks 218 and 220 are disposed to bear on respective column guide surfaces 222 of a side frame 224.

For the linkage arrangements as described, angle A is selected according to the desired mechanical advantage to be developed by a force F which acts through pantograph 200 to force friction blocks 218 and 220 into engagement with column surfaces 222 with a normal force of a preferred magnitude as indicated by arrows N. As shown, the force F, resulting from relative vertical movement of bolster 198 with respect to side frame 224, acts at pivot 214 and through links 196 and 206 to develop normal forces N. For relative vertical movement in the opposite direction between bolster 198 and side frame 224, the direction of force F is reversed and the force acts through link 216, pivot 210, and links 202 and 204 to develop the normal force N.

One way of developing forces F in either of opposed directions to act upon pantograph 196 is shown in FIG. 10 as a linkage assembly 226 connecting pivot 214 to a double-acting viscous damper 228 as follows. Linkage assembly 226 is comprised of a bellcrank 230 pivotally affixed as at 232 to bolster 198. One arm of bellcrank 230 extends outwardly of bolster 198 and is pivotally connected as at 234 to one end of damper 228, the opposite end of which is in turn pivotally connected as at 236 to a mounting lug portion 238 of side frame 224. Another arm of bellcrank 230 is pivotally connected as at 240 to a link 242, the opposed end of which is in turn pivotally connected as at 244 to a mounting lug portion 246 of linkage 196 adjacent pivot 214.

From the above description of FIGS. 9 and 10, it may be seen that when bolster 198 moves downward with respect to side frame 224, the viscous resistance supplied by damper 228 through bellcrank 230 and link 242 exerts a force F at pivot 214 thereby causing blocks 218 and 220 to bear upon column surfaces 222 with a normal force N whose magnitude is determined by the mechanical advantage developed through angle A.

When bolster 198 moves upward with respect to side frame 224, the double-acting damper 228 develops a restraining force in the opposite direction of force F which is applied through link 216 on pivot 210 and thence through links 210 and 204 to similarly develop a normal force of engagement between blocks 218, 220 and the respective column surfaces 222, again according to the mechanical advantage offered by angle A. The relationship between force F and normal force N is:

$$N = \frac{1}{2}\left(\frac{F}{\mathrm{Tan}(A)}\right)$$

Figure 11:
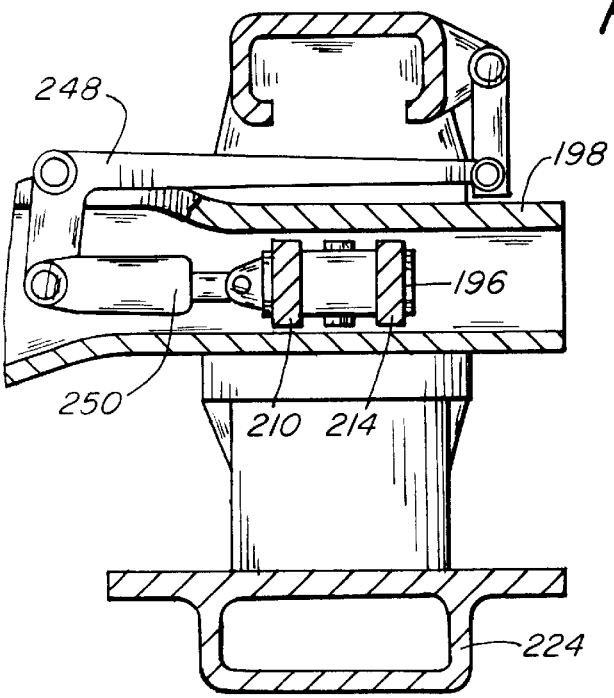
FIG. 11 is a view similar to FIG. 10 showing an alternative to the embodiment of FIG. 10.
Figure 12:
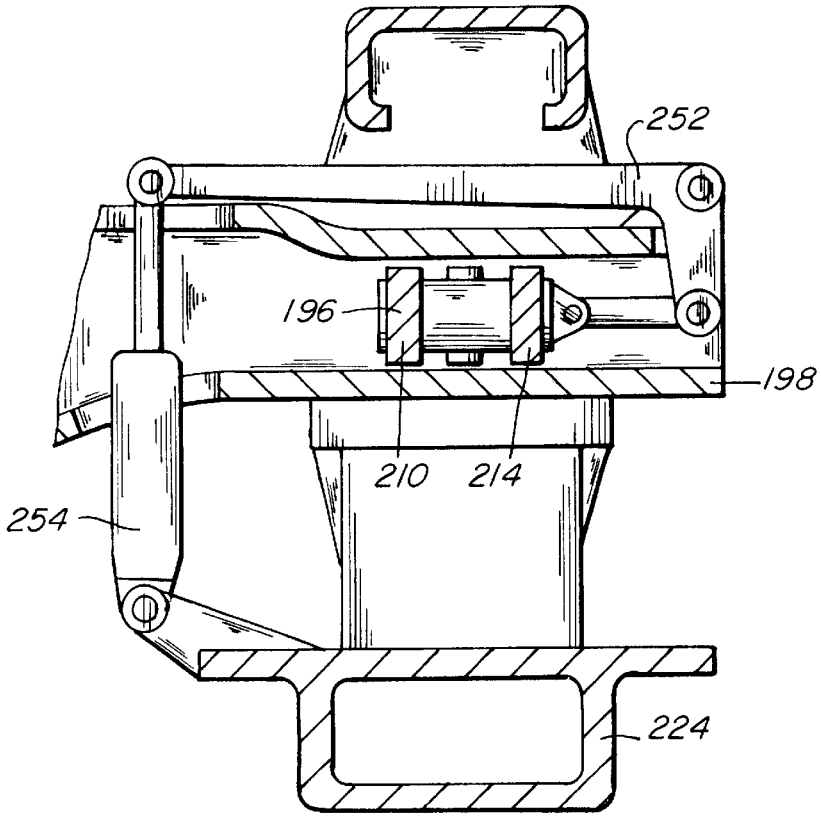
FIG. 12 is a view similar to FIG. 10 showing another alternative to the embodiment of FIG. 10.

FIGS. 11 and 12 illustrate alternatives to the FIG. 10 embodiment for developing the force F to be applied to pantograph 196. In FIG. 11, a bolster 198, side frame 224 and pantograph assembly 196 are essentially the same as described herein above with reference to FIGS. 9 and 10. In FIG. 11, however, a link, bellcrank and damper assembly 248 that is similar in many respects to that described with reference to FIG. 10 is so mounted with respect to bolster 198 and side frame 224 that it does not extend outward of bolster 198 and the damper 250 thereof is preferably confined within the bolster section. Operation of the FIG. 11 embodiment will be essentially as above described with reference to FIG. 10 in that vertical movement of bolster 198 with respect to side frame 224 causes, through the action of linkage arrangement 248, actuation of damper 250 which thereby applies a restraining force to one of pantograph pivots 210, 214, depending on the direction of the restraining force, to thereby generate the requisite normal force of engagement of the friction blocks upon the column guide surfaces.

In the alternative embodiment illustrated by FIG. 12, bolster 198 is vertically movable with respect to side frame 224 as herein above described. Pantograph 196 includes pivots 210 and 214 through which a restraining force is applied as above described by a link assembly 252 which includes a viscous damper 254 to generate the normal force of loading for the friction blocks upon the column guide surfaces. The operation of the FIG. 12 embodiment thus is essentially identical to that described herein above with reference to FIGS. 9 and 10.

For the embodiment of FIGS. 9 to 12 , it is necessary to limit slack and freedom in the system which could result in a reduction in angle A as load F is applied to the pantograph. If angle A becomes small enough, the friction developed in the pivot connections of the pantograph will not allow return of angle A and elimination of the normal forces N when the actuating force F is removed. Accordingly, suitable slack take-up or wear compensation structure is desirable for these embodiments to limit and control freedom in the system.

As with other described embodiments, the specific dimensions and other design criteria of the FIGS. 9 to 12 embodiments may be varied within a range consistent with the design requirements and mechanical limitations of the system, and according to the desired ranges of link movement, damper stroke, and mechanical advantage desired.

Further, a preferred modification that can be applied in all of the FIGS. 9 to 12 embodiments is to rotate the described pantograph assembly 196 through 90 degrees so that all of the pivot axes 208, 210, 212 and 214 are horizontal rather than vertical. With this arrangement, the connections between the pantograph 196, the viscous damper 228 and the side frame 224 can be simplified. For example, with the pantograph 196 rotated 90 degrees as described, damper 228 may be connected directly between the pantograph 196 and a lug 238 on the side frame spring seat, thus eliminating the need to employ additional links, as shown in FIG. 13.

We have invented and described a novel and improved method and apparatus for dissipating the energy of relative movement of a railway truck bolster with respect to the truck side frames. Notwithstanding the description herein above of certain presently preferred embodiments of the invention, various alternative and modified embodiments of the invention might well occur to those versed in the art once they were apprised of our invention. For example, it is intended that the invention could be applied to a variety of relative movements occurring in railway vehicle truck assemblies not limited to the relative movements between conventional truck bolsters and side frames. Accordingly, it is our intention that the invention should be construed broadly and limited only by the scope of the claims appended hereto.

We claim:

1. In a railway car truck having mutually cooperable car body supporting means and wheel supported means to support such a car body with respect to truck wheels, and wherein a friction means is movable in sliding frictional engagement with a surface means carried by one of said car body supporting means and said wheel supported means upon relative movement of said wheel supported means and said car body supporting means with respect to each other to dissipate the energy of such relative movement therebetween, the improvement comprising:

loading means cooperable with said friction means to apply a restraining force to said friction means in a manner that said restraining force contributes at least a portion of the normal force which evolves the friction between said friction means and said surface means, the magnitude of said restraining force varying with the velocity of said relative movement of said car body supporting means and said wheel supported means with respect to each other.

2. The improvement as set forth in claim 1 wherein said loading means includes a velocity dependent damper means.

3. The improvement as set forth in claim 2 wherein said velocity dependent damper means includes a hydraulic damper means.

4. The improvement as set forth in claim 3 wherein said hydraulic damper is a double acting hydraulic damper.

5. The improvement as set forth in claim 2 wherein said loading means further includes link means connecting said velocity dependent damper means with said friction means.

6. The improvement as set forth in claim 1 wherein said loading means is operable in response to relative movement between said friction means and said wheel supported means.

7. The improvement as set forth in claim 1 wherein said loading means is operable in response to relative movement between said friction means and said car body supporting means.

8. The improvement as set forth in claim 1 wherein said loading means is operable in response to such relative movement in plural directions.

9. In a railway car truck having mutually cooperable car body supporting means and wheel supported means to support such a car body with respect to truck wheels wherein said car body supporting means and said wheel supported means are relatively movable with respect to each other, energy dissipating means cooperable with said car body supporting means and said wheel supported means to dissipate the energy of relative movement therebetween comprising:

friction shoe means adapted for frictional sliding engagement on a surface means carried by one of said car body supporting means and said wheel supported means in response to relative movement of said car body supporting means and said wheel supported means with respect to each other; and loading means cooperable with said friction shoe means for applying a restraining force thereto in a manner that said restraining force evolves at least a portion of the friction between said friction shoe means and such a surface, the magnitude of said restraining force varying with the velocity of such relative movement of said car body supporting means and said wheel supported means with respect to each other.

10. The combination as set forth in claim 9 wherein said loading means includes velocity dependent damper means.

11. The combination as set forth in claim 10 wherein said velocity dependent damper means includes a hydraulic damper means.

12. The combination as set forth in claim 11 wherein said hydraulic damper means is a double acting hydraulic damper.

13. The combination as set forth in claim 10 wherein said loading means further includes link means connecting said velocity dependent damper means with said friction shoe means.

14. The combination as set forth in claim 9 wherein said loading means is operable in response to relative movement between said friction shoe means and said wheel supported means.

15. The combination as set forth in claim 9 wherein said loading means is operable in response to relative movement between said friction shoe means and said car body supporting means.

16. The combination as set forth in claim 9 wherein said loading means is operable in response to such relative movement of said car body supporting means and said wheel supported means with respect to each other in plural directions.

17. In a railway truck, the combination comprising:

a bolster adapted to support a car body thereon;

side frame means supported by railway truck wheels and adapted to support said bolster with respect to such railway truck wheels;

fit-up means for engaging said bolster and said side frame in mutually cooperable fit-up for support of said bolster by said side frame means;

said fit-up means including friction means which is engagable in frictional sliding engagement on a surface means of one of said bolster and said side frame means to dissipate the energy of relative movement of said bolster and said side frame means with respect to each other in response to such relative movements of said bolster and said side frame means with respect to each other;

loading means cooperable with said friction means to apply a restraining force thereto in a manner that said restraining force evolves at least a portion of the friction between said friction means and such surface means, the magnitude of said restraining force varying with the velocity of relative movement of said bolster and said side frame means with respect to each other.

18. The combination as set forth in claim 17 wherein said loading means includes a velocity dependent damper means.

19. The combination as set forth in claim 18 wherein said loading means further includes a link means connecting said velocity dependent damper means with said friction means.

20. The combination as set forth in claim 19 wherein said loading means is operable by operation of said velocity dependent damper in response to relative movement between said friction means and the one of said bolster and said side frame means engaged in frictional engagement therewith.

21. In a railway car truck having mutually cooperable car body supporting means and wheel supported means to support such a car body with respect to truck wheels, and wherein a friction means is movable in sliding frictional engagement with a surface means carried by one of said car body supporting means and said wheel supported means upon relative movement of said wheel supported means and said car body supporting means with respect to each other to dissipate the energy of such relative movement therebetween, the method of regulating frictional dissipation of the energy of relative movement between said wheel supported means and said car body supporting means comprising the steps of:

applying a restraining force to said friction means opposing the movement thereof in frictional sliding engagement with said surface means; and varying the magnitude of said restraining force in direct relation to the velocity of relative movement of said wheel supported means and said car body supporting means with respect to each other.

* * * * *